US007080877B1

(12) United States Patent
Tsai

(10) Patent No.: US 7,080,877 B1
(45) Date of Patent: Jul. 25, 2006

(54) FOLDING CHAIR WITH SLIDING LEG STRUCTURE

(75) Inventor: Hsin-Hung Tsai, Chiayi (TW)

(73) Assignee: Maxchief Investments, LTD (TW)

( * ) Notice: Subject to any disclaimer, the term of this patent is extended or adjusted under 35 U.S.C. 154(b) by 0 days.

(21) Appl. No.: 10/977,205

(22) Filed: Oct. 29, 2004

(51) Int. Cl.
*A47C 4/00* (2006.01)

(52) U.S. Cl. ..... 297/23; 297/16.1; 297/16.2; 297/24; 297/25; 297/56

(58) Field of Classification Search ..... 297/23, 297/16.1, 16.2, 24, 25, 56
See application file for complete search history.

(56) References Cited

U.S. PATENT DOCUMENTS

| | | | | | |
|---|---|---|---|---|---|
| 725,167 | A * | 4/1903 | Southard | 297/56 X |
| 1,423,594 | A * | 7/1922 | Barrows | 297/56 |
| 1,568,244 | A * | 1/1926 | Rosenkranz | 297/56 |
| 1,608,911 | A * | 11/1926 | Smith | 297/56 X |
| 1,721,164 | A * | 7/1929 | Newell et al. | 297/56 |
| 2,182,761 | A * | 12/1939 | Johnson | 297/56 |
| 2,649,141 | A * | 8/1953 | Marshall et al. | 297/56 X |
| 3,220,764 | A * | 11/1965 | Duer | 297/56 |
| 3,695,687 | A | 10/1972 | Uyeda | 297/56 |
| 6,056,354 | A | 5/2000 | Tseng | 297/56 |
| 6,340,205 | B1 * | 1/2002 | Battiston | 297/56 X |
| 6,382,716 | B1 | 5/2002 | Wu | 297/56 |
| 6,899,384 | B1 * | 5/2005 | Tseng | 297/16.1 X |

FOREIGN PATENT DOCUMENTS

| | | |
|---|---|---|
| EP | 1 127 516 A1 | 8/2001 |

* cited by examiner

*Primary Examiner*—Rodney B. White
(74) *Attorney, Agent, or Firm*—Luedeka, Neely & Graham

(57) ABSTRACT

A folding chair is configurable into a use position and a storage position. The folding chair includes a backrest, a seat, and inner and outer support structures. The outer support structure includes substantially parallel first and second elongate outer support members, each having an upper portion attached to the backrest and a lower portion disposed adjacent an underlying surface when the chair is in the use position. The seat is pivotally attached to the outer support structure between the first and second elongate outer support members. The inner support structure is pivotally attached to the outer support structure between the first and second elongate outer support members. The inner support structure includes substantially parallel first and second elongate inner support members disposed on opposing sides of the seat. Upper portions of the first and second elongate inner support members are slidably attached to the seat. Lower portions of the first and second elongate inner support members are disposed adjacent the underlying surface when the chair is in the use position. When the chair is in the storage position, the seat, the backrest, the inner support structure and the outer support structure are substantially coplanar. Based on the coplanarity of these structures, the stacking thickness of the chair is determined by the thickness of the seat and the backrest. Accordingly, the chair has a very low profile and minimized stacking thickness when it is in the storage position.

18 Claims, 4 Drawing Sheets

FOLDING CHAIR WITH SLIDING LEG STRUCTURE

FIELD

This invention relates to a folding chair. More particularly the invention relates to a folding chair having a leg structure that slides in relation to the seat structure as the chair is folded and unfolded.

BACKGROUND

Compared to other seating devices, folding chairs offer the advantages of being compact and lightweight. Generally, folding chairs are easier to store and transport than are non-folding chairs. Further, folding chairs may often be purchased at a lower cost than non-folding chairs.

Typically, a folding chair consists of a seat, a backrest, and foldable support structures, including front and rear legs. When in an open position, the seat supports the weight of a person while the backrest provides support for the person's back, so the person may comfortably lean back while seated.

A problem with many folding chairs is that they sometimes inadvertently fold up while a person is sitting in the chair. For example, when a person seated in a folding chair attempts to slide the chair forward, such as toward a table, the legs of the chair may experience forces that tend to cause the legs to fold together. Also, in many types of folding chairs, if more weight is placed at the rear of the seat than is at the front of the seat, the chair has a tendency to fold up. In either situation, the person seated in the chair may become unbalanced and possibly fall, or at least may have to readjust the chair.

In addition to instability problems, many folding chairs do not fold into a flat and compact package. In most designs, the front and rear leg structures and seat cannot all collapse down into coplanar positions due to interference between the leg structures, or between the seat and the leg structures. The inability of many prior art chairs to fold flat makes such chairs difficult to stack. Also, when stacked, these chairs take up more space than would be used if they folded flat.

What is needed, therefore, is a folding chair that is stable and secure when unfolded and in use, and that folds into a flat, compact package for transport and storage.

SUMMARY

The above and other needs are met by a folding chair that is configurable into a use position and a storage position. When configured in the use position, the folding chair supports a seated person above an underlying surface. The folding chair includes a seat portion, an inner support structure, an outer support structure and a backrest.

The seat portion of the folding chair has a front member, a rear member, and opposing first and second side members. The first side and second members of the seat have first and second elongate slots therein. The seat portion includes opposing first and second seat pivot points disposed toward the rear member of the seat portion. The first seat pivot point is disposed adjacent the first side member and the second seat pivot point is disposed adjacent the second side member.

The inner support structure of the folding chair includes opposing first and second elongate inner support members, each having upper and lower portions. The upper portions of the first and second elongate inner support members are coupled to the first and second side members of the seat portion in a sliding relationship to the first and second elongate slots. The lower portions of the first and second elongate inner support members are disposed adjacent the underlying surface when the folding chair is configured in the use position. The first elongate inner support member has a first inner pivot point disposed between its upper and lower portions, and the second elongate inner support member has a second inner pivot point disposed between its upper and lower portions.

The outer support structure of the folding chair includes opposing first and second elongate outer support members, each having an upper portion and a lower portion. The lower portions of the first and second elongate outer support members are disposed adjacent the underlying surface when the folding chair is configured in the use position. The first elongate outer support member includes a first upper pivot point and a first lower pivot point. The first upper pivot point is disposed between the upper and lower portions of the first elongate outer support member, and is pivotally coupled to the first seat pivot point so that the seat portion is pivotally coupled to the first elongate outer support member. The first lower pivot point is disposed between the first upper pivot point and the lower portion of the first elongate outer support member. The first lower pivot point is pivotally coupled to the first inner pivot point, so that the first elongate inner support member is pivotally coupled to the first elongate outer support member.

The lower portion of the second elongate outer support member includes a second upper pivot point and a second lower pivot point. The second upper pivot point, which is disposed between the upper and lower portions of the second elongate outer support member, is pivotally coupled to the second seat pivot point. In this manner, the seat portion is pivotally coupled to the second elongate outer support member. The second lower pivot point is disposed opposing the first lower pivot point and between the second upper pivot point and the lower portion of the second elongate outer support member. The second lower pivot point is pivotally coupled to the second inner pivot point, so that the second elongate inner support member is pivotally coupled to the second elongate outer support member.

The backrest portion of the folding chair is attached to the outer support structure adjacent the upper portions of the first and second elongate outer support members.

In preferred embodiments of the folding chair, the seat portion, the inner support structure, the outer support structure and the backrest are substantially coplanar when the chair is in the storage position. Based on the coplanarity of these structures, the stacking thickness of the chair is determined by the thickness of the seat and the projection of the backrest rearward from the outer support structure. Accordingly, the chair has a very low profile and minimized stacking thickness when it is in the storage position.

In one preferred embodiment, the folding chair includes a backrest, a seat, and inner and outer support structures. The outer support structure includes substantially parallel first and second elongate outer support members, each having an upper portion attached to the backrest and a lower portion disposed adjacent the underlying surface when the chair is in the use position. The seat is pivotally attached to the outer support structure between the first and second elongate outer support members. The inner support structure is pivotally attached to the outer support structure between the first and second elongate outer support members. The inner support structure includes substantially parallel first and second elongate inner support members disposed on opposing sides of the seat, each having upper and lower portions. The upper portions of the first and second elongate inner support members are slidably attached to the seat. The lower portions are disposed adjacent the underlying surface when the chair is in the use position. When the chair is in the storage position, the seat, the backrest, the inner support structure and the outer support structure are substantially coplanar.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
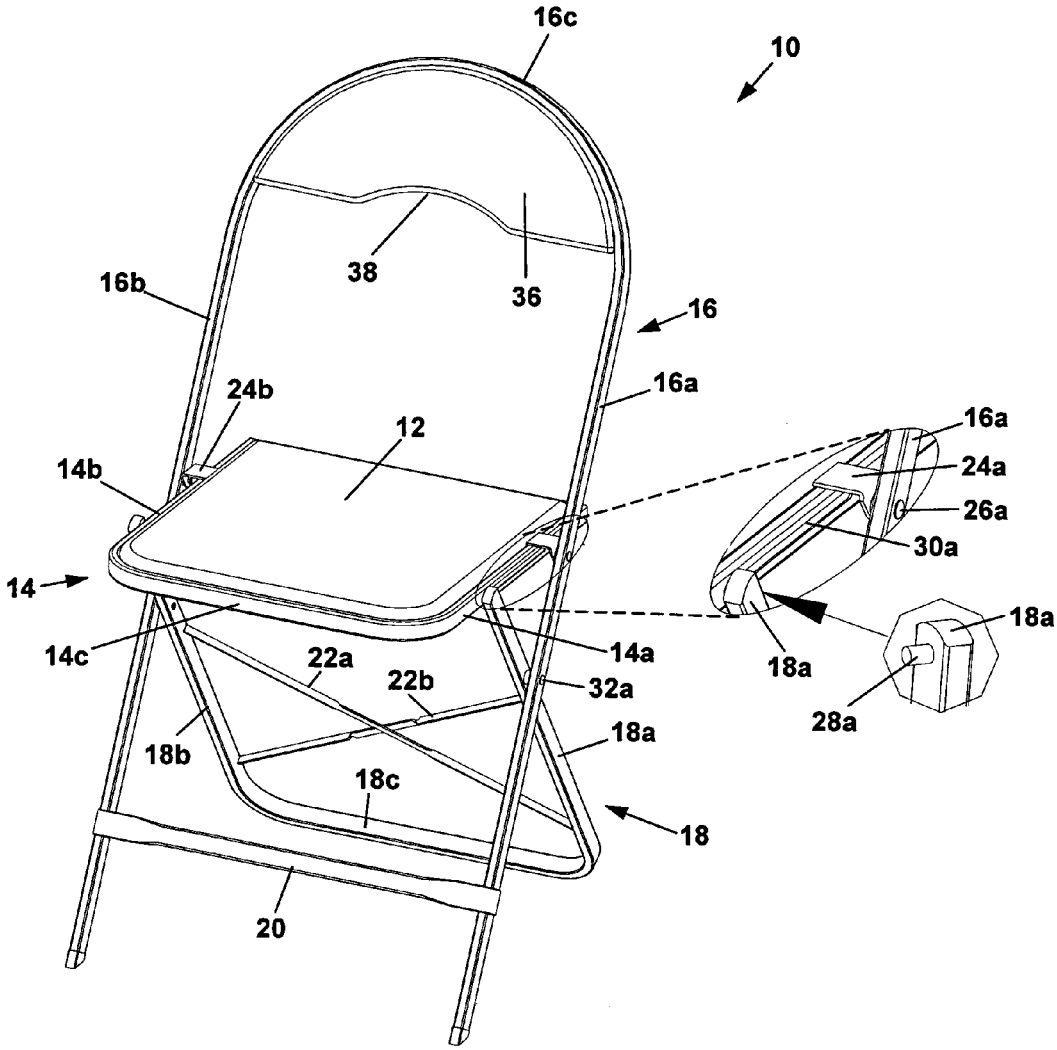
FIG. 1 is a perspective view of a preferred embodiment of a folding chair in a use position.
Figure 2:
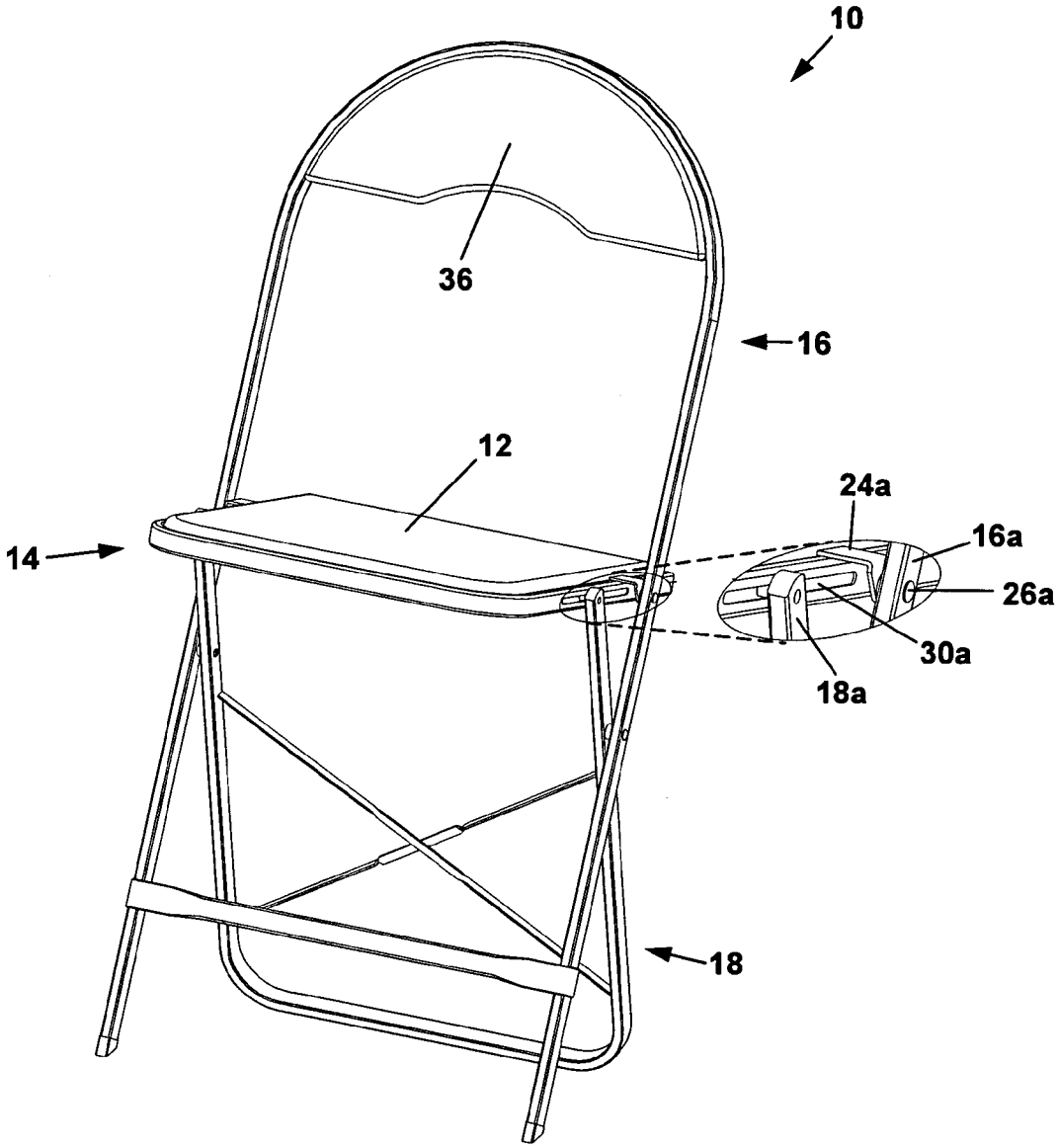
FIG. 2 is a perspective view of the preferred embodiment of the folding chair in a partially folded position.
Figure 3:
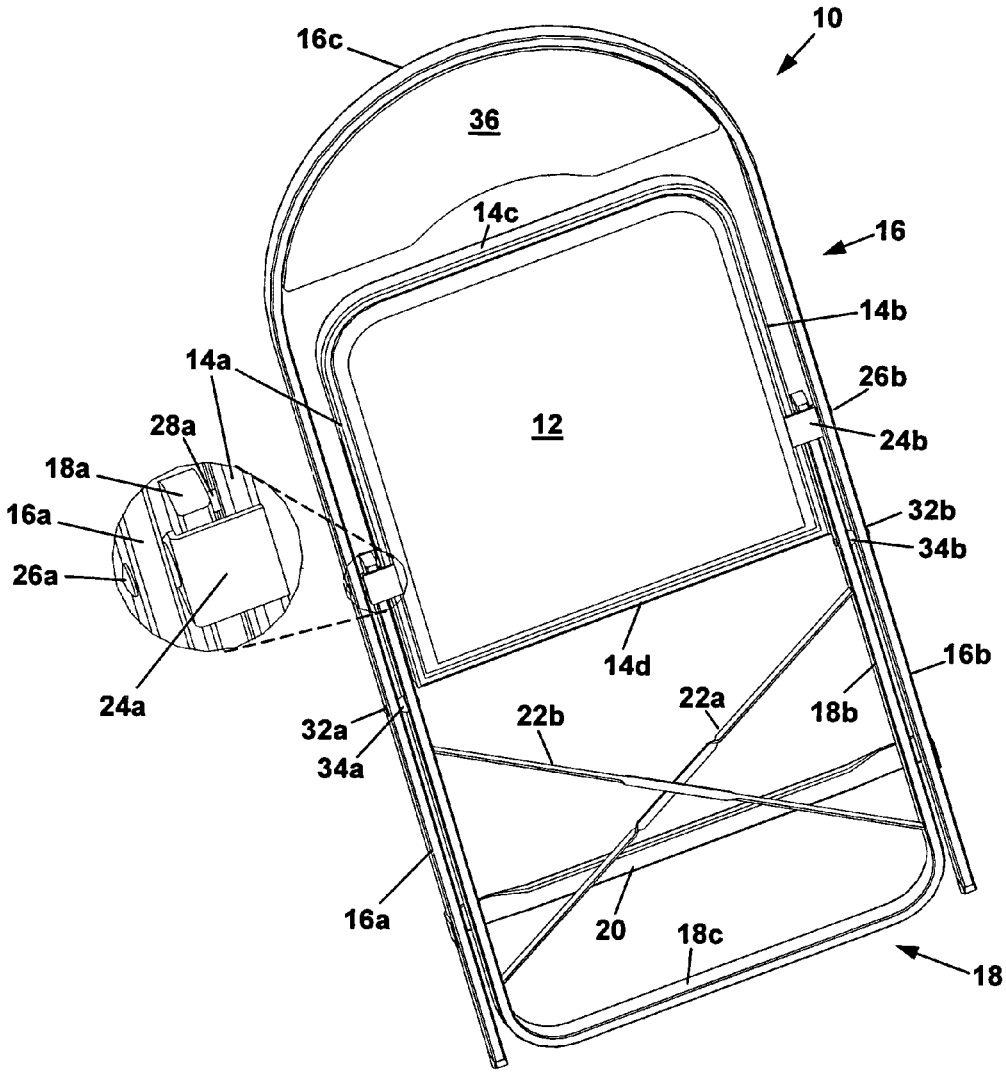
FIG. 3 is a perspective view of the preferred embodiment of the folding chair in a storage position.

FIGS. 1–6 depict a folding chair 10 according to a preferred embodiment of the invention. The folding chair 10 includes a seat 12 surrounded by a seat frame 14. The seat 12 and frame 14 are supported in a substantially horizontal position by an outer support structure 16 and an inner support structure 18. The seat 12 is preferably formed of fabric or vinyl over an underlying support panel, but could also be formed from metal, wood, or plastic. If made of plastic, the seat 12 may be formed by any one of a number of plastic molding processes, such as injection molding or blow molding.

Figure 6:
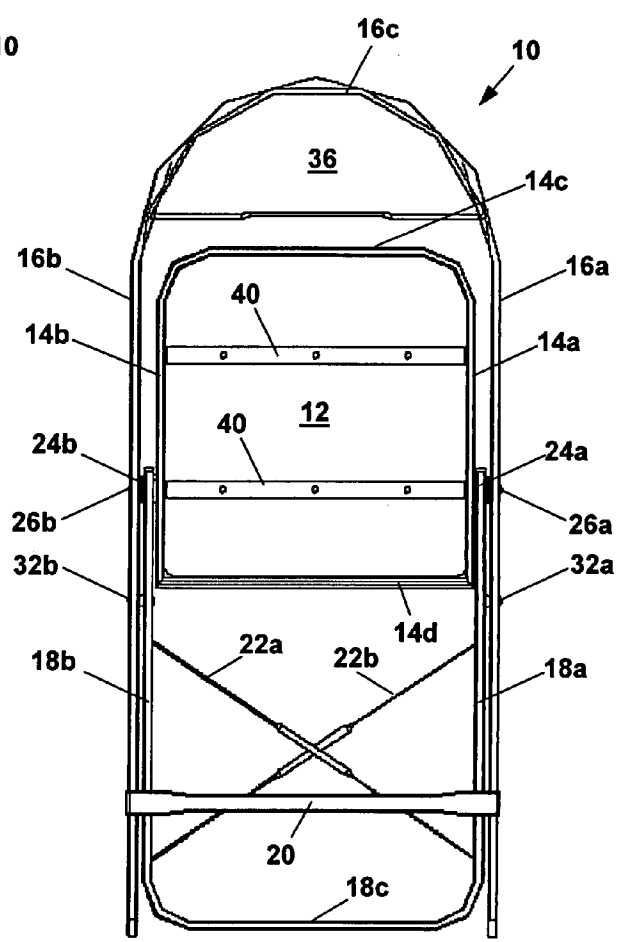
FIG. 6 is a front view of the preferred embodiment of the folding chair in the storage position.
Figure 5:
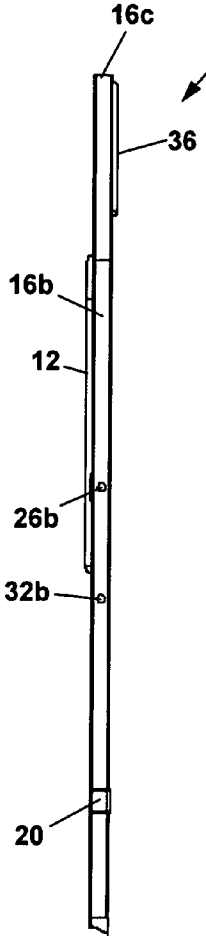
FIG. 5 is a side view of the preferred embodiment of the folding chair in the storage position.
Figure 4:
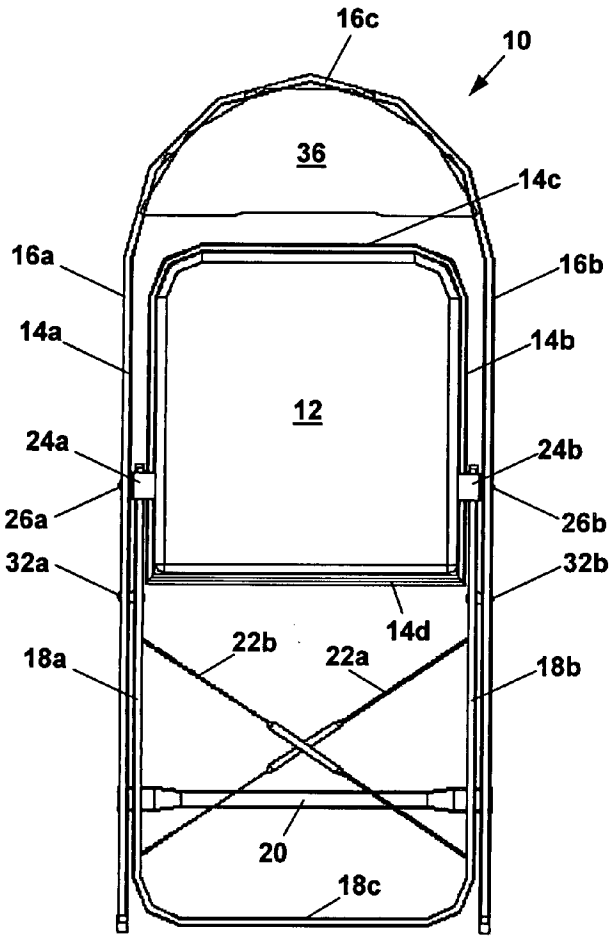
FIG. 4 is a rear view of the preferred embodiment of the folding chair in the storage position.

In the preferred embodiment of the invention, the seat frame 14 is formed of a unitary piece of metal tubing comprising side members 14*a*–14*b* and a front member 14*c*. A rear member 14*d* is preferably welded to the side members 14*a*–14*b*. As shown in FIG. 6, the seat frame 14 preferably includes transverse braces 40 attached between the side members 14*a*–14*b* to support the seat 12 when it is subjected to the weight of a person sitting thereon.

The outer support structure 16 preferably includes first and second outer support members 16*a*–16*b*, and a transverse upper member 16*c* disposed between the first and second outer support members 16*a*–16*b*. In the preferred embodiment, the first outer support member 16*a*, the second outer support member 16*b* and the transverse upper member 16*c* are formed from a unitary piece of material, which is preferably metal. The transverse upper member 16*c* is preferably formed into an arcuate, semicircular shape as shown in FIGS. 1–4 and 6. However, it should be appreciated that the transverse upper member 16*c* could have other shapes, such as a straight, semi-oval or semi-elliptical. It should also be appreciated that the transverse upper member 16*c* and the first and second outer support members 16*a*, 16*b* could be formed as separate pieces that are joined together, such as by welding, to form the outer support structure 16. To provide further stability to the outer support structure 16, a cross brace 20 is preferably provided as shown in FIGS. 1–4 and 6.

Attached to the transverse upper member 16*c* is a backrest 36. The backrest 36 is preferably formed of fabric or vinyl over an underlying support panel, but could also be formed of metal, wood, or plastic. If made of plastic, the backrest 36 may be formed by any one of a number of plastic molding processes, such as injection molding or blow molding. Although the backrest 36 is preferably semicircular in shape, it should be appreciated that the backrest 36 may take on any shape that is consistent with the configuration of the support members 16*a*, 16*b* and 16*c* to which it is attached. The backrest 36 of the preferred embodiment includes a handle cutout 38 to provide a convenient place to grasp the chair 10 for moving or carrying.

As shown in FIGS. 1–4 and 6, the inner support structure 18 includes first and second inner support members 18*a*–18*b*, and a transverse lower member 18*c* disposed between the first and second inner support members 18*a*–18*b*. In the preferred embodiment, the first inner support member 18*a*, the second inner support member 18*b* and the transverse lower member 18*c* are formed from a unitary piece of material, which is preferably metal. The transverse lower member 18*c* is preferably substantially straight where it contacts the surface on which the chair 10 is used. Also, it should be appreciated that the transverse lower member 18*c* and the first and second inner support members 18*a*–18*b* could be formed as separate pieces that are joined together, such as by welding, to form the inner support structure 18. To provide further stability to the inner support structure 18, cross braces 22*a*–22*b* are preferably provided as shown in FIGS. 1–4 and 6.

The inner support structure 18 is pivotally attached to the outer support structure 16 by pivot pins 32*a*–32*b*. Spacers 34*a*–34*b* are preferably provided at the pivot points to maintain proper spacing between the inner and outer support structures 16 and 18. Bushings may also be provided at the pivot points to decrease friction as the inner support structure 18 pivots in relation to the outer support structure 16.

The seat 12 is pivotally attached to the outer support structure 16 by angle brackets 24*a*, 24*b* and pivot pins 26*a*, 26*b*. In the preferred embodiment, the pivot pins 26*a*, 26*b* pass through holes in the outer support members 16*a*, 16*b* and the angle brackets 24*a*, 24*b*. The angle brackets 24*a*, 24*b* are preferably formed of metal, and are preferably spot welded to the upper surface of the opposing side members 14*a*–14*b* of the seat frame 14.

The seat frame 14 has slots 30*a*–30*b* formed in the outer surfaces of the opposing side members 14*a*–14*b*. In the preferred embodiment of the invention, the slots 30*a*, 30*b* are about 6 inches long and about 0.25 inch wide. However, it should be appreciated that the dimensions of the slot may be different in other embodiments of the invention. As shown in the inset views provided in FIG. 1, the slots 30*a*–30*b* receive slide pins 28*a*–28*b* that are attached to the inside of the upper ends of the inner support members 18*a*–18*b*. The outer diameter of the slide pins 28*a*–28*b* is slightly less than the width of the slots 30*a*–30*b*, thereby allowing the slide pins 28*a*–28*b* to freely slide within the slots 30*a*–30*b*.

In the preferred embodiment, the slots 30*a*–30*b* are formed in the outer surfaces of the side members 14*a*–14*b* of the seat frame 14. In other embodiments of the invention, the slots 30*a*–30*b* are formed in the inner surfaces of the side members 14*a*–14*b*, or in the bottom surface of the seat frame 14. In these other embodiments, the slide pins 28*a*–28*b* are relocated as necessary to slide within the slots 30*a*–30*b*.

With reference to the figures, the chair 10 transitions from the unfolded position of FIG. 1 to the folded position of FIGS. 3–6 when a continuous upward and inward force is applied to the bottom surface of the forward portion of the seat frame 14. As the chair folds, the seat frame 14 pivots about an axis defined by the pivot pins 26*a*–26*b*. As the forward portion of the front member 14*c* of the seat frame 14 moves upward and inward, the slide pins 28*a*–28*b* slide within the slots 30*a*–30*b*, and the inner support members 18*a*–18*b* pivot about an axis defined by the pivot pins 32*a*–32*b*.

When the chair is completely folded as shown in FIGS. 3–6 the seat frame 14, the outer support structure 16 and the inner support structure 18 are all substantially co-aligned. In this position, the rear surfaces of the inner support members 18*a*–18*b* are preferably adjacent the bottom surfaces of the angle brackets 24*a*–24*b* and the forward surfaces of the inner support members 18*a*–18*b* are preferably adjacent the rear surface of the forward cross brace 20. In this position, the seat frame 14 is completely nested between the inner support members 18*a*–18*b* which are completely nested within the outer support members 16*a*–16*a*. Thus, in the folded position, the seat 12 is substantially coplanar with the inner support structure 18 and the outer support structure 16, thereby making the chair 10 as flat and compact as possible. As shown most clearly in FIG. 5, the stacking thickness of the chair 10 is then determined by the thickness of the seat 12 and the projection of the backrest 36 rearward from the outer support structure 16.

In an alternative embodiment, the slots 30*a*–30*b* are disposed in the inner walls of the side members 14*a*–14*b* of the tubular seat frame 14, and the slide pins 28*a*–28*b* that slide within the slots 30*a*–30*b* are disposed on the inner surfaces of the inner support members 18*a*–18*b*. In this embodiment, the side members 14*a*–14*b* of the seat frame 14 have channels formed in their bottom surfaces for receiving the inner support members 18*a*–18*b* when they are collapsed into the storage position. Apertures are provided in the outer surfaces of the side members 14*a*–14*b* of the seat 14 for receiving the pivot pins 26*a*–26*b*. In this embodiment, the inner support members 18*a*–18*b* are received within the channels in the bottom of the side members 14*a*–14*b* of the seat frame 14 rather than between the side members 14*a*–14*b* and the outer support members 16*a*–16*b*. Accordingly, the seat frame 14 may be wider and the angle brackets 24*a*–24*b* may be eliminated.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A folding chair configurable into a use position and a storage position, the folding chair for supporting a seated person above an underlying surface when configured in the use position, the folding chair comprising:

a seat portion including:

a front member;

a rear member opposing the front member;

a first side member disposed adjacent a first outer edge of the seat portion, the first side member having a first elongate slot therein;

a second side member opposing the first side member and disposed adjacent a second outer edge of the seat portion, the second side member having a second elongate slot therein;

a first seat pivot point disposed adjacent the first side member toward the rear member of the seat portion; and a second seat pivot point disposed opposing the first seat pivot point and adjacent the second side member toward the rear member of the seat portion;

an inner support structure comprising:

a first elongate inner support member having an upper portion coupled to the first side member in a sliding relationship to the first elongate slot, a lower portion disposed adjacent the underlying surface when the folding chair is configured in the use position, and a first inner pivot point disposed between the upper portion and the lower portion of the first elongate inner support member; and a second elongate inner support member opposing the first elongate inner support member, the second elongate inner support member having an upper portion coupled to the second side member in a sliding relationship to the second elongate slot a lower portion disposed adjacent the underlying surface when the folding chair is configured in the use position, and a second inner pivot point disposed opposing the first inner pivot point and between the upper portion and the lower portion of the second elongate inner support member;

an outer support structure comprising:

a first elongate outer support member having an upper portion and a lower portion, the lower portion disposed adjacent the underlying surface when the folding chair is configured in the use position, the first elongate outer support member further comprising:

a first upper pivot point disposed between the upper portion and the lower portion of the first elongate outer support member, the first upper pivot point pivotally coupled to the first seat pivot point, whereby the seat portion is pivotally coupled to the first elongate outer support member; and a first lower pivot point disposed between the first upper pivot point and the lower portion of the first elongate outer support member, the first lower pivot point pivotally coupled to the first inner pivot point, whereby the first elongate inner support member is pivotally coupled to the first elongate outer support member; and a second elongate outer support member opposing the first elongate outer support member, the second elongate outer support member having an upper portion and a lower portion, the lower portion disposed adjacent the underlying surface when the folding chair is configured in the use position, the second elongate outer support member further comprising:

a second upper pivot point disposed opposing the first upper pivot point and between the upper portion and the lower portion of the second elongate outer support member, the second upper pivot point pivotally coupled to the second seat pivot point, whereby the seat portion is pivotally coupled to the second elongate outer support member; and a second lower pivot point disposed opposing the first lower pivot point and between the second upper pivot point and the lower portion of the second elongate outer support member, the second lower pivot point pivotally coupled to the second inner pivot point, whereby the second elongate inner support member is pivotally coupled to the second elongate outer support member; and a backrest portion attached to the outer support structure adjacent the upper portions of the first and second elongate outer support members, where in the storage position, the front and rear members and first and second side members of the seat portion are substantially coplanar with the first and second elongate outer support members of the outer support structure, the first and second elongate inner support members of the inner support structure are substantially coplanar with the first and second elongate outer support members of the outer support structure, and the seat portion is coplanar with the backrest portion such that the seat portion does not overlap the backrest portion.

2. The folding chair of claim 1 wherein the outer support structure further comprises a transverse upper member attached to the upper portion of the first elongate outer support member and the upper portion of the second elongate outer support member; and the backrest portion is attached to the transverse upper member.

3. The folding chair of claim 2 wherein the transverse upper member is integrally formed with the first elongate outer support member and the second elongate outer support member.

4. The folding chair of claim 3 wherein the transverse upper member, the first elongate outer support member and the second elongate outer support member comprise a continuous piece of metal.

5. The folding chair of claim 1 wherein the inner support structure further comprises a transverse lower member attached to the lower portion of the first elongate inner support member and the lower portion of the second elongate inner support member.

6. The folding chair of claim 5 wherein the transverse lower member is integrally formed with the first elongate inner support member and the second elongate inner support member.

7. The folding chair of claim 5 wherein the transverse lower member, the first elongate inner support member and the second elongate inner support member comprise a continuous piece of metal.

8. The folding chair of claim 5 wherein the transverse lower member rests on the underlying surface when the chair is in the use position.

9. The folding chair of claim 1 further comprising:

a first pivot bracket attached to the first side member of the seat portion;

a second pivot bracket attached to the second side member of the seat portion;

the first elongate outer support member being pivotally connected to the first pivot bracket; and the second elongate outer support member being pivotally connected to the second pivot bracket, wherein the upper portion of the first elongate inner support member is disposed against the first pivot bracket when the chair is in the storage position, and the upper portion of the second elongate inner support member is disposed against the second pivot bracket when the chair is in the storage position.

10. The folding chair of claim 1 wherein the first elongate inner support member further comprises a first slide pin extending from the upper portion thereof, the first slide pin disposed within the first elongate slot for sliding therein as the chair is configured from the use position to the storage position, and the second elongate inner support member further comprises a second slide pin extending from the upper portion thereof, the second slide pin disposed within the second elongate slot for sliding therein as the chair is configured from the use position to the storage position.

11. The folding chair of claim 1 wherein the first elongate slot is disposed in an outside surface of the first side member of the seat portion, and the second elongate slot is disposed in an outside surface of the second side member of the seat portion.

12. The folding chair of claim 1 wherein the first elongate slot is disposed in an inside surface of the first side member of the seat portion, and the second elongate slot is disposed in an inside surface of the second side member of the seat portion.

13. A folding chair configurable into a use position and a storage position, and for supporting a seated person above an underlying surface when configured in the use position, the folding chair comprising:

a backrest;

an outer support structure comprising substantially parallel first and second elongate outer support members, each having an upper portion attached to the backrest and a lower portion disposed adjacent the underlying surface when the chair is in the use position;

a seat pivotally attached to the outer support structure between the first and second elongate outer support members; and an inner support structure pivotally attached to the outer support structure between the first and second elongate outer support members, the inner support structure comprising substantially parallel first and second elongate inner support members disposed on opposing sides of the seat, each having an upper portion slidably attached to the seat and a lower portion disposed adjacent the underlying surface when the chair is in the use position, wherein the seat, the backrest, the inner support structure and the outer support structure are coplanar when the chair is in the storage position such that the seat does not overlap the backrest.

14. The folding chair of claim 13 having a maximum thickness that is substantially no greater than the thickness of the seat when the chair is in the storage position.

15. The folding chair of claim 13 wherein the seat includes first and second elongate slots disposed adjacent the opposing sides of the seat, the first elongate inner support member includes a first slide pin engaging the first elongate slot, and the second elongate inner support member includes a second slide pin engaging the second elongate slot, whereby the first and second slide pins may freely slide within the first and second elongate slots as the chair is configured from the use position to the storage position.

16. The folding chair of claim 15 wherein the first elongate slot is disposed in a first outside surface of the seat, and the second elongate slot is disposed in a second outside surface of the seat opposite the first outside surface.

17. The folding chair of claim 13 wherein the seat includes first seat pivot point disposed adjacent one side of the seat and a second seat pivot point disposed adjacent the opposing side of the seat, the first elongate inner support member includes a first inner pivot point disposed between the upper portion and the lower portion of the first elongate inner support member, the second elongate inner support member includes a second inner pivot point disposed between the upper portion and the lower portion of the second elongate inner support member, the first elongate outer support member includes:

a first upper pivot point disposed between the upper portion and the lower portion of the first elongate outer support member, the first upper pivot point pivotally coupled to the first seat pivot point, whereby the seat is pivotally coupled to the first elongate outer support member; and a first lower pivot point disposed between the first upper pivot point and the lower portion of the first elongate outer support member, the first lower pivot point pivotally coupled to the first inner pivot point, whereby the first elongate inner support member is pivotally coupled to the first elongate outer support member; and the second elongate outer support member includes:

a second upper pivot point disposed between the upper portion and the lower portion of the second elongate outer support member, the second upper pivot point pivotally coupled to the second seat pivot point, whereby the seat is pivotally coupled to the second elongate outer support member; and a second lower pivot point disposed between the second upper pivot point and the lower portion of the second elongate outer support member, the second lower pivot point pivotally coupled to the second inner pivot point, whereby the second elongate inner support member is pivotally coupled to the second elongate outer support member.

18. A folding chair configurable into a use position and a storage position, the folding chair for supporting a seated person above an underlying surface when configured in the use position, the folding chair comprising:

a seat portion including:

a front member;

a rear member opposing the front member;

a first side member disposed adjacent a first outer edge of the seat portion, the first side member having a first elongate slot therein;

a second side member opposing the first side member and disposed adjacent a second outer edge of the seat portion, the second side member having a second elongate slot therein:

a first pivot bracket attached to the first side member of the seat portion and extending outward there from, the first pivot bracket providing a first seat pivot point with a first space between the first seat pivot point and the first side member; and a second pivot bracket attached to the second side member of the seat portion and extending outward there from, the second pivot bracket providing a second seat pivot point with a second space between the second seat pivot point and the second side member;

an inner support structure comprising:

a first elongate inner support member having an upper portion coupled to the first side member in a sliding relationship to the first elongate slot, a lower portion disposed adjacent the underlying surface when the folding chair is configured in the use position, and a first inner pivot point disposed between the upper portion and the lower portion of the first elongate inner support member, wherein the upper portion of the first elongate inner support member is disposed in the first space between the first seat pivot point and the first side member of the seat portion when the chair is in the storage position; and a second elongate inner support member opposing the first elongate inner support member, the second elongate inner support member having an upper portion coupled to the second side member in a sliding relationship to the second elongate slot, a lower portion disposed adjacent the underlying surface when the folding chair is configured in the use position, and a second inner pivot point disposed opposing the first inner pivot point and between the upper portion and the lower portion of the second elongate inner support member, wherein the upper portion of the second elongate inner support member is disposed in the second space between the second seat pivot point and the second side member of the seat portion when the chair is in the storage position;

an outer support structure comprising:

a first elongate outer support member having an upper portion and a lower portion, the lower portion disposed adjacent the underlying surface when the folding chair is configured in the use position, the first elongate outer support member further comprising:

a first upper pivot point disposed between the upper portion and the lower portion of the first elongate outer support member, the first upper pivot point pivotally coupled to the first seat pivot point of the first pivot bracket, whereby the seat portion is pivotally coupled to the first elongate outer support member; and a first lower pivot point disposed between the first upper pivot point and the lower portion of the first elongate outer support member, the first lower pivot point pivotally coupled to the first inner pivot point, whereby the first elongate inner support member is pivotally coupled to the first elongate outer support member; and a second elongate outer support member opposing the first elongate outer support member, the second elongate outer support member having an upper portion and a lower portion, the lower portion disposed adjacent the underlying surface when the folding chair is configured in the use position, the second elongate outer support member further comprising:

a second upper pivot point disposed opposing the first upper pivot point and between the upper portion and the lower portion of the second elongate outer support member, the second upper pivot point pivotally coupled to the second seat pivot point of the second pivot bracket, whereby the seat portion is pivotally coupled to the second elongate outer support member; and a second lower pivot point disposed opposing the first lower pivot point and between the second upper pivot point and the lower portion of the second elongate outer support member, the second lower pivot point pivotally coupled to the second inner pivot point, whereby the second elongate inner support member is pivotally coupled to the second elongate outer support member; and a backrest portion attached to the outer support structure adjacent the upper portions of the first and second elongate outer support members.

* * * * *